US010327471B2

(12) United States Patent
Zhu

(10) Patent No.: US 10,327,471 B2
(45) Date of Patent: Jun. 25, 2019

(54) ELECTRONIC CIGARETTE

(71) Applicant: SHENZHEN KONTLE ELECTRONICS CO., LTD., Shenzhen (CN)

(72) Inventor: Xiaochun Zhu, Shenzhen (CN)

(73) Assignee: SHENZHEN KONTLE ELECTRONICS CO., LTD., Shenzhen (CN)

( * ) Notice: Subject to any disclaimer, the term of this patent is extended or adjusted under 35 U.S.C. 154(b) by 0 days.

(21) Appl. No.: 15/680,244

(22) Filed: Aug. 18, 2017

(65) Prior Publication Data

US 2017/0340007 A1 Nov. 30, 2017

Related U.S. Application Data

(63) Continuation of application No. 13/993,962, filed as application No. PCT/CN2011/072291 on Mar. 30, 2011, now Pat. No. 9,801,413.

(30) Foreign Application Priority Data

Mar. 28, 2011 (CN) ..... 2011 1 0075226

(51) Int. Cl.
*A24F 47/00* (2006.01)

(52) U.S. Cl.
CPC ..... *A24F 47/002* (2013.01); *A24F 47/008* (2013.01)

(58) Field of Classification Search
CPC ..... A24F 47/002; A24F 47/004; A24F 47/008
See application file for complete search history.

(56) References Cited

U.S. PATENT DOCUMENTS

2005/0016550 A1* 1/2005 Katase ..... A24F 47/002 131/194
2011/0303231 A1* 12/2011 Li ..... A24F 47/008 131/329

FOREIGN PATENT DOCUMENTS

JP 3164992 U * 12/2010 ..... A24F 47/008

* cited by examiner

*Primary Examiner* — Joseph S Del Sole
*Assistant Examiner* — Mohamed K Ahmed Ali
(74) *Attorney, Agent, or Firm* — Hemisphere Law, PLLC

(57) ABSTRACT

An electronic cigarette has a conduit arranged in a atomizing stem, the conduit has a first segment and a second segment in communication with the first segment, the first segment has a wider inner space than the inner space of the second segment; a storage chamber is outside and surrounds the conduit; and a heating device arranged inside the inner space of the first segment of the conduit for atomizing an atomizable material coming from the storage chamber.

11 Claims, 7 Drawing Sheets

ELECTRONIC CIGARETTE

CROSS REFERENCE

This is a continuation of U.S. patent application Ser. No. 13/993,962, filed on Jun. 13, 2013, which is a national phase application (371) of international application No. PCT/CN2011/072291, filed on Jun. 13, 2011, which claims priority to China Application No. 2001110075226.4 filed on Mar. 28, 2011, the entire disclosure of each of which is incorporated herein by reference.

SUMMARY OF THE INVENTION

The present invention relates to an electronic cigarette, and in particular, to an electronic cigarette which has no cigarette cotton in its structure.

BACKGROUND ART

An existing electronic cigarette structure is normally provided with a tobacco juice storage unit connected to a heating unit. Normally cigarette cotton is used as a guiding material for tobacco juice between the heating unit and the storage unit in the industry. The cigarette cotton used in the existing electronic cigarette increases the cost, and is neither environmental-friendly nor hygienic, which is likely to cause secondary pollution. In addition, the existing electronic cigarette structure has a poor sealing effect, which is prone to a tobacco juice leakage and may result in a poor atomizing effect of the electronic cigarette and a small amount of smoke, thereby affecting effect of use for a user to a certain extent. In addition, because the existing electronic cigarette requires its components to be welded, soldering tin and soldering flux need to be used during welding, which directly result in soldering tin pollution and soldering flux pollution.

Therefore, it is necessary to provide an improved electronic cigarette which overcomes the defects of the prior art.

CONTENT OF THE INVENTION

An object of the present invention is to provide an environmental-friendly and highly efficient electronic cigarette that has a scientific structure, a low cost, and a good atomizing effect.

To achieve the object, the present invention uses the following technical solution.

An electronic cigarette includes a hollow atomizing stem, a first conductive ring sleeved at the bottom of the atomizing stem and airproof with the atomizing stem, a second conductive ring arranged in the first conductive ring and insulated from it, a conduit held in the atomizing stem, with base contacting the first conductive ring tightly, a liquid blocker arranged on the top of the atomizing stem, and a cigarette holder arranged on the top of the atomizing stem simultaneously and holding the liquid blocker therein. The inner wall of said atomizing stem, the outer wall of said conduit, the top of said first conductive ring, and the bottom of said liquid blocker together confine a liquid storage chamber for storing tobacco juice.

Compared with the prior art, the present invention has the following advantages:

an integral design is realized for a heating unit and a tobacco juice storage unit of an electronic cigarette according to the present invention, a dedicated storage space is formed, the overall structure uses a vacuum-simulation design, and no cigarette cotton is required for guiding a flow between the tobacco juice storage unit and the heating unit, and the atomizing effect is obviously improved, so that a generated air flow may better meet requirements of an electronic cigarette, the taste is more close to a true cigarette, and at the same time tobacco juice is sealed for storage, and the validity duration of the tobacco juice is greatly increased; in addition, the overall structure of the electronic cigarette is simplified, manufacturing cost is reduced, and production efficiency is improved.

The components of the electronic cigarette according to the present invention are not connected by welding, which effectively avoids pollution of soldering tin and soldering flux, thereby making it more environmental-friendly and hygienic.

The liquid blocker, the cigarette holder, and the body of the electronic cigarette according to the present invention are detachably connected, and after the tobacco juice is depleted, refilling can be performed, thereby prolonging the service life of the electronic cigarette.

SPECIFIC EMBODIMENT

The present invention is further described below with reference to accompanying drawings and an embodiments.

Figure 1:
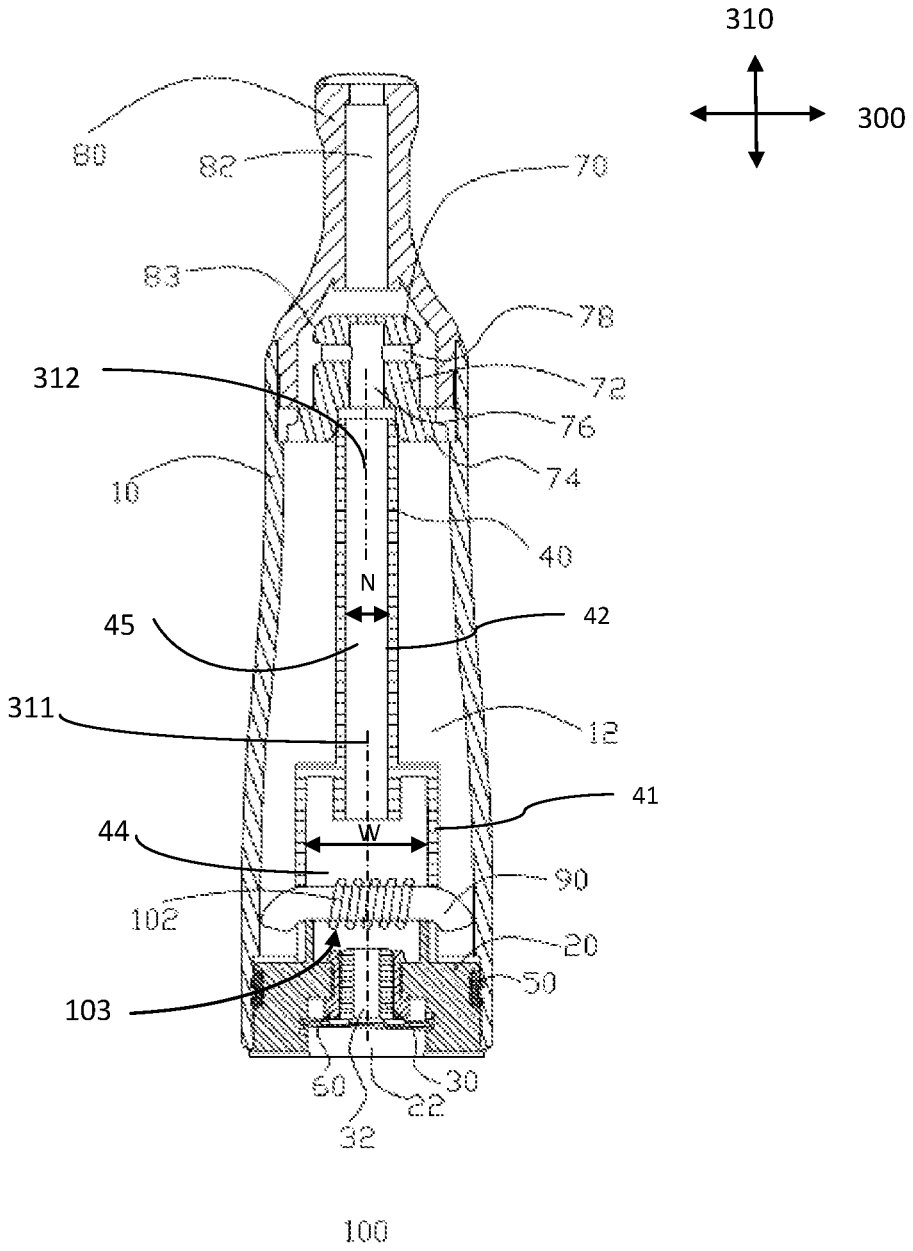
FIG. 1 is a sectional structural view of an electronic cigarette according to the present invention.
Figure 2:
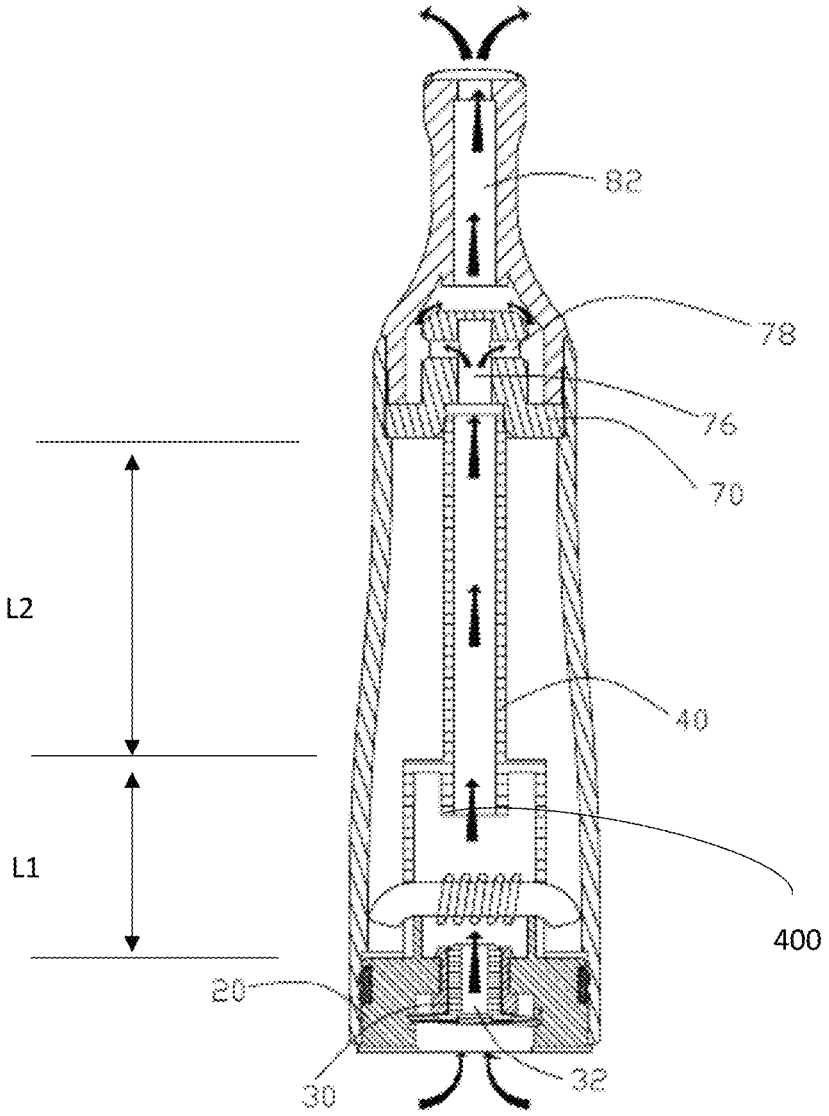
FIG. 2 illustrates a path though which an air flow of the electronic cigarette shown in FIG. 1 flows.
Figure 3:
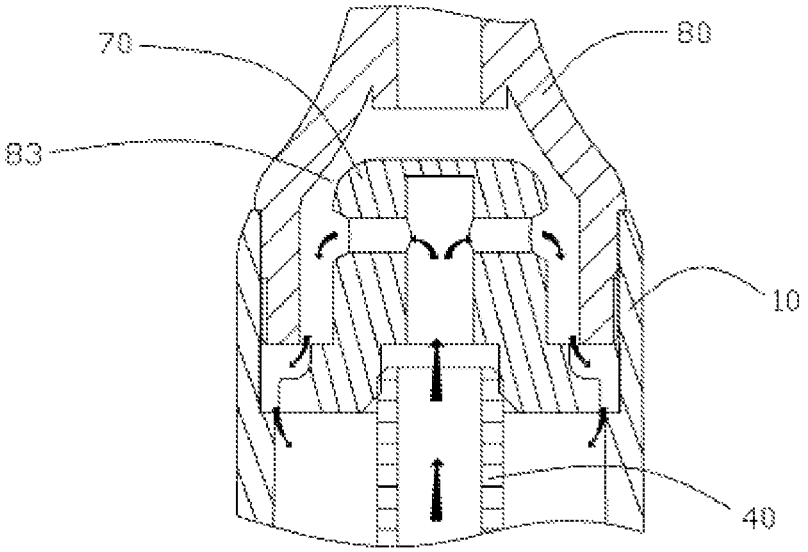
FIG. 3 illustrates in detail a flow path of the air flow path shown in FIG. 2 at the top of the electronic cigarette.
Figure 4:
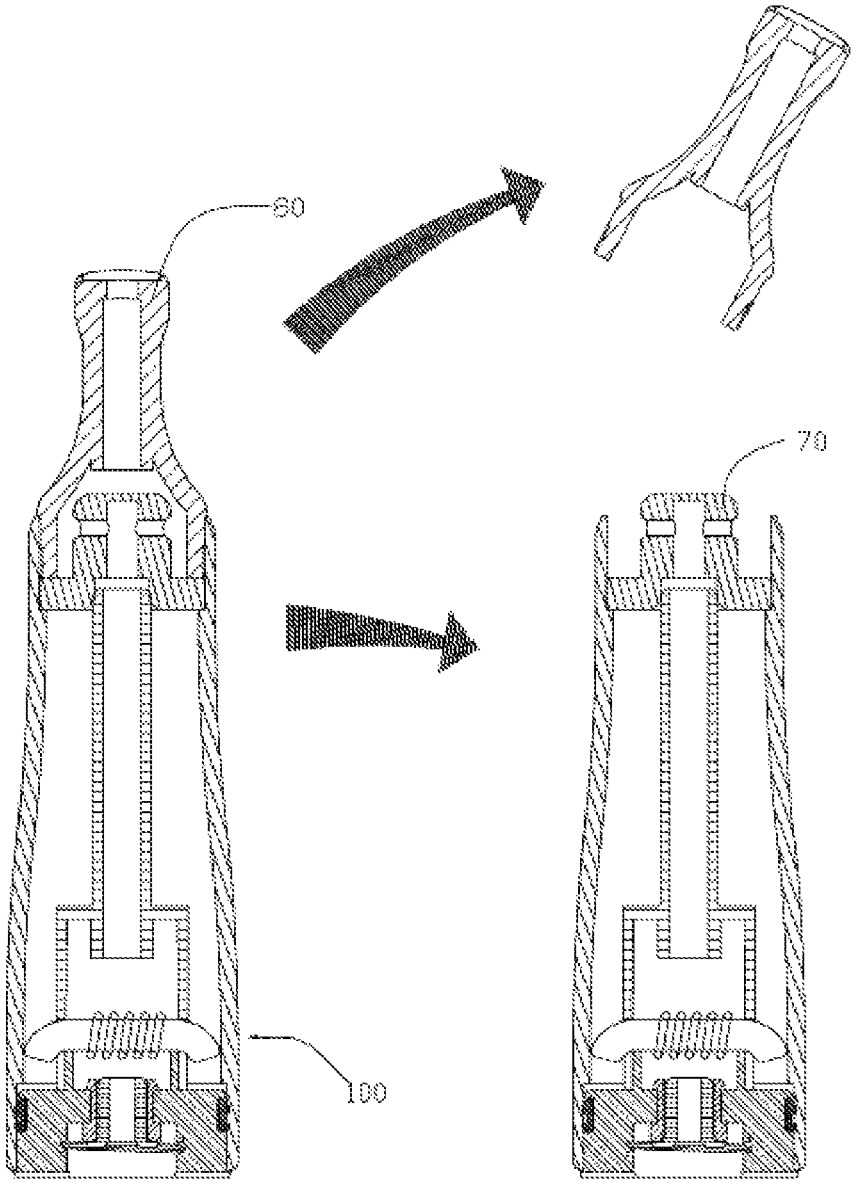
FIG. 4 illustrates one of steps of filling tobacco juice into the electronic cigarette according to the present invention.
Figure 5:
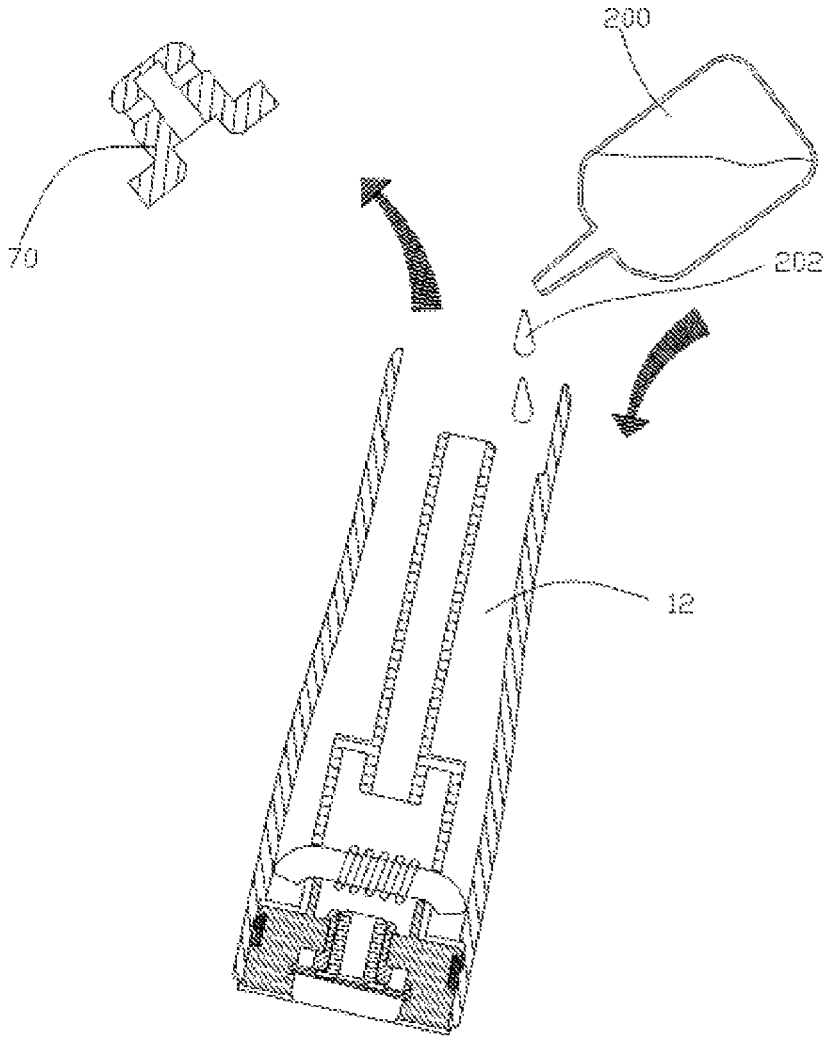
FIG. 5 illustrates one of steps of filling tobacco juice into the electronic cigarette according to the present invention.
Figure 6:
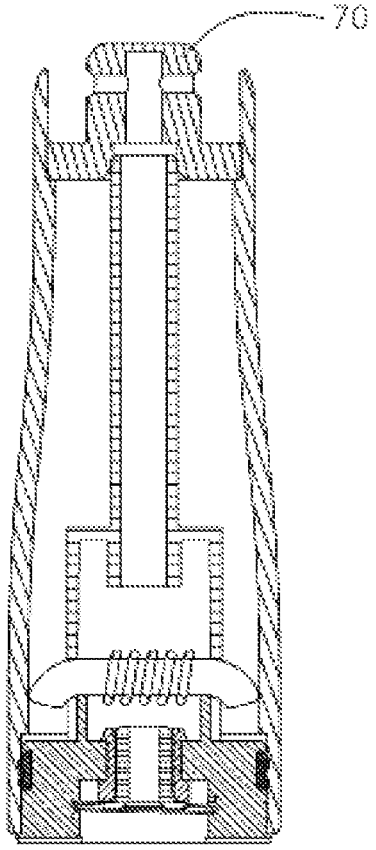
FIG. 6 illustrates one of steps of filling tobacco juice into the electronic cigarette according to the present invention.
Figure 7:
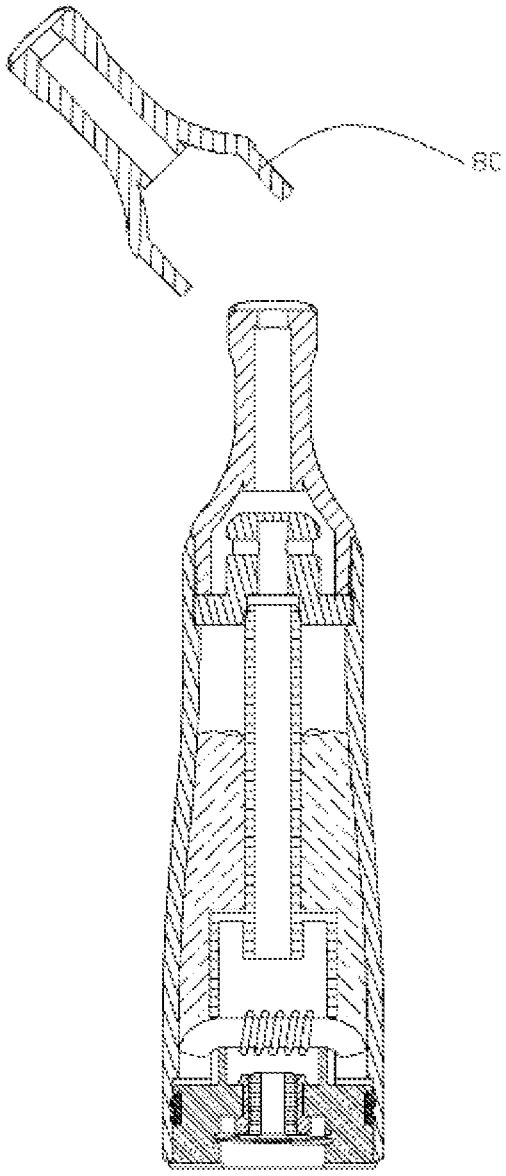
FIG. 7 illustrates one of steps of filling tobacco juice into the electronic cigarette according to the present invention.

Referring to FIGS. 1 to 3, an electronic cigarette 100 according to the present invention includes a cylindrical hollow atomizing stem 10, a first conductive ring 20 sleeved at the bottom of said atomizing stem 10 and airproof with the atomizing stem 10 by using a leakproof rubber ring 50, a second conductive ring 30 arranged in said first conductive ring 20 and insulated from the first conductive ring 20 by an insulation ring 60, a conduit 40 held in said atomizing stem 10, with base contacting said first conductive ring 20 tightly, a liquid blocker 70 arranged on the top of the atomizing stem 10, and a cigarette holder 80 arranged on the top of the atomizing stem 10 simultaneously and holding the liquid blocker 70 therein. The cigarette holder 80 also serves as a mouthpiece of the electronic cigarette 100.

One feature of the electronic cigarette according to the present invention lies in that, the inner wall of said atomizing stem 10, the outer wall of said conduit 40, the top of said first conductive ring 20, and the bottom of said liquid blocker 70 together confine a liquid storage chamber 12 for storing tobacco juice therein. This liquid storage chamber 12, because of its good seal from other components of the electronic cigarette 100, can store tobacco juice without cigarette cotton, so the structure of the electronic cigarette 100 is greatly simplified as compared with a structure of the prior art.

Referring to FIGS. 1-2, the conduit 40 includes a first segment 41 and a second segment 42 in communication with the first segment 41; the first segment 41 extends from an end of the second segment 42, away from the cigarette holder 80; the first segment 41 has an inner dimension W along a transverse direction 300 inside the first segment 41, and the second segment 42 has an inner dimension N along the transverse direction 300 inside the second segment 42; the inner dimension W is larger than the inner dimension N. In other words, and according to FIGS. 1 and 2, the inner space 44 within the first segment 41 along the transverse direction 300 is wider than the inner space 45 inside the second segment 42 along the transverse direction 300. Further referring to FIGS. 1-2, the first segment 41 has an axis 311 along a longitudinal direction 310, and the second segment 42 has an axis 312 along the longitudinal direction 310 of the second segment 42, and the axis 311 and the axis 312 overlap or extend along the longitudinal direction 310.

Another feature of the electronic cigarette according to the present invention lies in that, the electronic cigarette 100 further includes a fiber rope 90, wherein two end portions of said fiber rope 90 are placed within the liquid storage chamber 12, and a middle portion thereof passes transversally through said conduit 40 and is held inside first segment 41 of the conduit 40. In addition, a portion of said fiber rope 90 that is held within the first segment 41 of the conduit 40 (i.e., the middle portion) is wrapped with a heating wire 102, as a heating device 103, so that when tobacco juice is injected into said liquid storage chamber 12, the tobacco juice is automatically adsorbed into the fiber rope 90, and when the heating wire 102 is energized, the heating wire 102 atomizes the tobacco juice adsorbed in the fiber rope 90. This atomizing method has a high atomizing speed and generates more smoke as compared with the prior art.

Preferably, said first conductive ring 20 is provided at the bottom with a battery compartment 22, and at the top with a mounting hole (not identified) in communication with said battery compartment 22, wherein said second conductive ring 30 is mounted within the mounting hole, and said second conductive ring 30 is longitudinally provided with a flow-guiding hole 32 therein. Further, said insulation ring 60 is arranged between said first conductive ring 20 and said second conductive ring 30.

The two ends of said heating wire 102 are electrically connected to the first conductive ring 20 and the second conductive ring 30, respectively. When a battery is mounted in the battery compartment 22, positive and negative poles of the battery is respectively connected to said first and second conductive rings 20 and 30, so that the heating wire 102 is energized and thus provides heat, thereby quickly atomizing tobacco juice in the fiber rope 90.

Said liquid blocker 70 includes a body portion 72 and a flange 74 formed at the bottom of the body portion 72, wherein said flange 74 seals said liquid storage chamber 12, thereby preventing tobacco juice in the liquid storage chamber 12 from flowing backwards. The body portion 72 of said liquid blocker 70 is provided with a longitudinal hole 76 in communication with an interior of the conduit 40 and a transverse hole 78 in communication with the longitudinal hole 76. In addition, a gap 83 is formed between two side edges at the top of the body portion 72 and the inner wall of said cigarette holder 80.

An air flow hole 82 in communication with said transverse hole 78 is formed inside said cigarette holder 80.

A working procedure of the electronic cigarette 100 according to the present invention is described below. Referring to FIGS. 1 to 3, the heating wire 102 is heated up to produce a high temperature, thereby atomizing tobacco juice in the fiber rope 90. When a user sucks the electronic cigarette 100 from the cigarette holder 80, air outside the battery compartment 22 flows through the flow-guiding hole 32 into the conduit 40, and when flowing upwards, the external air carries smoke generated by atomizing the tobacco juice to flow. The mixed air flow goes through the conduit 40, i.e., traveling from the first segment, through the second segment, and then flows into the air flow hole 82 inside the cigarette holder 80 through the longitudinal hole 76, the transverse hole 78, and the gap 83, and is finally inhaled by the user.

FIGS. 4 to 7 illustrate a procedure of filling tobacco juice into the liquid storage chamber 12. Firstly, the cigarette holder 80 is removed from the electronic cigarette 100. Then, the liquid blocker 70 is removed. The electronic cigarette is inclined at a certain angle, and then tobacco juice is poured from a bottle 200 into the liquid storage chamber 12. After that, the liquid blocker 70 and the cigarette holder 80 are mounted one by one, thereby completing the procedure of filling tobacco juice.

An integral design is realized for a heating unit and a tobacco juice storage unit of the electronic cigarette according to the present invention, the overall structure uses a vacuum-simulation design, no cigarette cotton is required for guiding a flow between the tobacco juice storage unit and the heating unit, and the atomizing effect is obviously improved, so that a generated air flow may better meet requirements of an electronic cigarette, the taste is more close to a true cigarette, and at the same time tobacco juice is sealed for storage, and a validity duration of the tobacco juice is greatly increased; in addition, the overall structure of the electronic cigarette is simplified, manufacturing cost is reduced, and production efficiency is improved.

The components of the electronic cigarette according to the present invention are not connected by welding, which effectively avoids pollution of soldering tin and soldering flux, thereby making it more environmental-friendly and hygienic.

The liquid blocker, the cigarette holder, and the body of the electronic cigarette according to the present invention are detachably connected, and after the tobacco juice is depleted, refilling can be performed, thereby prolonging the service life of the electronic cigarette.

The embodiment mentioned above is a preferable embodiment of the present invention, but is not intended to limit the present invention. Any other changes, modifications, replacements, combinations, and simplifications made without departing from the spiritual essence and principle of the present invention are within the scope of the present invention.

What is claimed is:

1. An electronic cigarette, comprising a hollow atomizing stem, a conduit arranged in the atomizing stem, an absorbing device, a heating wire, and a cigarette holder arranged on a top of the atomizing stem, wherein a liquid storage chamber is defined between a inner wall of the atomizing stem and an outer wall of the conduit, the conduit comprises a first segment and a second segment, and a length of the first segment is shorter than a length of the second segment, wherein the first segment has a first inner dimension along a transverse direction inside the first segment and the second segment has a second inner dimension along the transverse direction inside the second segment; and the first inner dimension is larger than the second inner dimension, two end portions of the absorbing device are placed within the liquid storage chamber, and a middle portion of the absorbing device passes transversally through the first segment of the conduit and is held inside the first segment of the conduit, the heating wire wound around the middle portion of the absorbing device, and wherein second segment is positioned between the first segment and the cigarette holder.

2. An electronic cigarette, comprising:

a hollow atomizing stem;

a cigarette holder arranged on a top of the atomizing stem;

a conduit arranged in the atomizing stem, comprising a first segment and a second segment in communication with the first segment, wherein the first segment has a first inner dimension along a transverse direction inside the first segment and the second segment has a second inner dimension along the transverse direction inside the second segment; and the first inner dimension is larger than the second inner dimension, and a length of the first segment is shorter than a length of the second segment;

a storage chamber for holding an atomizable liquid;

a powering unit; and a heating device arranged inside the first segment of the conduit to be powered by the powering unit for atomizing the atomizable liquid into an aerosol, wherein, when in use, the aerosol travels from the first segment, through the second segment, to the cigarette holder.

3. The electronic cigarette according to claim 2, wherein the second segment is positioned between the cigarette holder and the first segment.

4. The electronic cigarette according to claim 2, wherein the heating device comprises a heating wire.

5. The electronic cigarette according to claim 4, wherein the electronic cigarette further comprises an absorbing device, the two end portions of the absorbing device are placed outside the first segment, and a middle portion of the absorbing device passes transversally through the first segment of the conduit and is held inside the first segment of the conduit, the heating wire wound around the middle portion of the absorbing device.

6. The electronic cigarette of claim 2, wherein the first segment has a first axis along a longitudinal direction of the first segment, and the second segment has a second axis along a longitudinal direction of the second segment, and the first axis and the second axis overlaps.

7. The electronic cigarette of claim 2, wherein the first segment has a first axis along a longitudinal direction of the first segment, and the second segment has a second axis along a longitudinal direction of the second segment, and the first axis and the second axis are parallel.

8. An electronic cigarette, comprising:

a hollow atomizing stem;

a cigarette holder arranged on a top of the atomizing stem;

a conduit arranged in the atomizing stem, comprising a first segment and a second segment in communication with the first segment, wherein a first inner dimension along a transverse direction inside the first segment is larger than a second inner dimension along the transverse direction inside the second segment a length of the first segment is shorter than a length of the second segment, and the second segment is between the cigarette holder and the first segment;

a storage chamber outside and surrounding the conduit for holding an atomizable material;

a powering unit; and a heating device arranged inside the first segment of the conduit, wherein, when in use, the heating device, powered by the powering unit, atomizes the atomizable material coming from the storage chamber.

9. The electronic cigarette according to claim 8, wherein the heating device comprises a heating wire, and the electronic cigarette further comprises an absorbing device for absorbing the atomizable material from the storage chamber; the heating wire wounds around the absorbing device, and the atomizable material comes from the storage chamber to the heating wire via the absorbing device.

10. The electronic cigarette of claim 8, wherein the first segment has a first axis, and the second segment has a second axis, and the first axis and the second axis overlap.

11. The electronic cigarette of claim 8, wherein the first segment has a first axis, and the second segment has a second axis, and the first axis and the second axis extend along a same longitudinal direction.

* * * * *